US007748576B2

(12) United States Patent
Tseng

(10) Patent No.: US 7,748,576 B2
(45) Date of Patent: Jul. 6, 2010

(54) PUMP ASSEMBLY WITH PRESSABLE HEAD

(75) Inventor: Sen-Li Tseng, Taichung (TW)

(73) Assignee: Hsih Tung Tooling Co., Ltd., Taichung (TW)

( * ) Notice: Subject to any disclaimer, the term of this patent is extended or adjusted under 35 U.S.C. 154(b) by 396 days.

(21) Appl. No.: 11/781,967

(22) Filed: Jul. 24, 2007

(65) Prior Publication Data

US 2009/0028734 A1 Jan. 29, 2009

(51) Int. Cl.
*B67D 5/42* (2006.01)

(52) U.S. Cl. ..... 222/321.2; 222/321.9; 222/341

(58) Field of Classification Search ..... 222/321.1, 222/321.2, 321.4, 321.6, 321.7, 321.9, 340, 222/341
See application file for complete search history.

(56) References Cited

U.S. PATENT DOCUMENTS 4,693,675 A * 9/1987 Venus, Jr. ..... 417/489
5,176,296 A * 1/1993 Lina et al. ..... 222/321.2
5,234,135 A * 8/1993 LaFosse et al. ..... 222/321.2
5,337,926 A * 8/1994 Drobish et al. ..... 222/309
5,482,188 A * 1/1996 Lina ..... 222/321.2
5,638,996 A * 6/1997 Montaner et al. ..... 222/321.2
5,803,318 A * 9/1998 Lina ..... 222/321.2
6,036,059 A * 3/2000 VanBrocklin ..... 222/321.9
6,056,163 A * 5/2000 Lai ..... 222/321.2
6,398,079 B1 * 6/2002 Garcia et al. ..... 222/190
6,536,630 B1 * 3/2003 Chan et al. ..... 222/207
6,966,459 B1 * 11/2005 Tseng ..... 222/153.13
2005/0279770 A1 * 12/2005 Moretti ..... 222/321.7

* cited by examiner

*Primary Examiner*—Kevin P Shaver
*Assistant Examiner*—Donnell Long

(57) ABSTRACT

A pump assembly with a pressable head includes a push tube, an inner tube, a stop valve, and an outer tube; a top of the push tube passing through the outer tube; the push tube communicates with the inner tube; a bottom of the inner tube is formed with an annular plug; the annular plug of the inner tube has a plurality of via holes defined therein. The via holes have inclined inner walls. A top of the inner tube has a stop valve; the stop valve is a flat structure; an elastic structure is formed on a periphery of the stop valve; by elastic deformation of the elastic structure, the stop valve tightly adheres to an inner wall of the outer tube; an interior of the outer tube has a stepped structure with a greater diameter at an upper side and a smaller diameter at a lower side.

12 Claims, 13 Drawing Sheets

PUMP ASSEMBLY WITH PRESSABLE HEAD

FIELD OF THE INVENTION

The present invention relates to pump assemblies, and particularly to a pump assembly with a pressable head, wherein the walls of the components of the pump assembly will be protected from cracking so that the liquid in the container assembled with the pump assembly will be tightly sealed in the container; and thus the operation of sucking liquid is performed effectively.

BACKGROUND OF THE INVENTION

The prior art liquid cleaning container is a suction tube in a lower end of a stepped tube. An upper end of a stepped tube is a tube cover and a rotary cover. A piston is received in the stepped tube and a seat with a sealed cover end is installed. A via hole is at a lower end of the stepped tube. A top of the seat has a middle connecting tube. An upper connected tube is connected to the middle connecting tube and then the upper connecting tube is connected to a spray head. A steel ball is installed between a small tube at a lower end of the stepped tube and at an upper end of the stepped tube. A spring is installed in the middle connecting tube. An upper end of the spring is inserted into the lower end of the seat. Therefore, by pressing the spray head, the piston will move downwards. Then the spray head is released so that the piston will generates suction force by the ejection force from the spring. Then the steel ball will be pushed away so that the emulsion in the container will suck into the suction tube. When the head is pressed again, the piston moves downwards and then the emulsion flows out from the via hole of the seat into the middle connecting tube so as to be extruded out from the spraying head.

However, the prior art has the defects that if the emulsion contains particles, the walls of the components of the containers will be worn and cracked so that the operation is inefficient, even for a long time, the suction function is destroyed.

SUMMARY OF THE INVENTION

Accordingly, the primary object of the present invention is to provide a pump assembly with a pressable head, wherein the walls of the components of the pump assembly are protected from cracking so that the liquid in the container assembled with the pump assembly is tightly sealed in the container; and thus the operation of sucking liquid is performed effectively.

To achieve above objects, the present invention provides a pump assembly with a pressable head, which comprises a push tube, an inner tube, a stop valve, and an outer tube; the push tube is a tubular structure; a top of the push tube passes through the outer tube; the push tube being is communicated with the inner tube; the inner tube is a tubular structure; a bottom of the inner tube has an annular plug formed thereon; the annular plug has a plurality of via holes defined therein, the plurality of via holes has inclined inner walls; the stop valve is disposed on a top of the inner tube; the stop valve is a flat structure; an elastic structure is formed on a periphery of the stop valve; by the elastic deformation of the periphery of the stop valve, the stop valve tightly adheres to an inner wall of the outer tube; a plurality of stoppers protrudes from a bottom of the stop valve and corresponds to the via holes; and the outer tube is a tubular structure; an interior of the outer tube is a stepped structure which has a greater diameter at an upper side and a smaller diameter at a lower side; a largest diameter of the interior of the outer tube is greater than outer peripheries of the push tube and the inner tube so that the push tube and inner tube are received in the outer tube.

The various objects and advantages of the present invention will be more readily understood from the following detailed description when read in conjunction with the appended drawing.

DETAILED DESCRIPTION OF THE INVENTION

Figure 1:
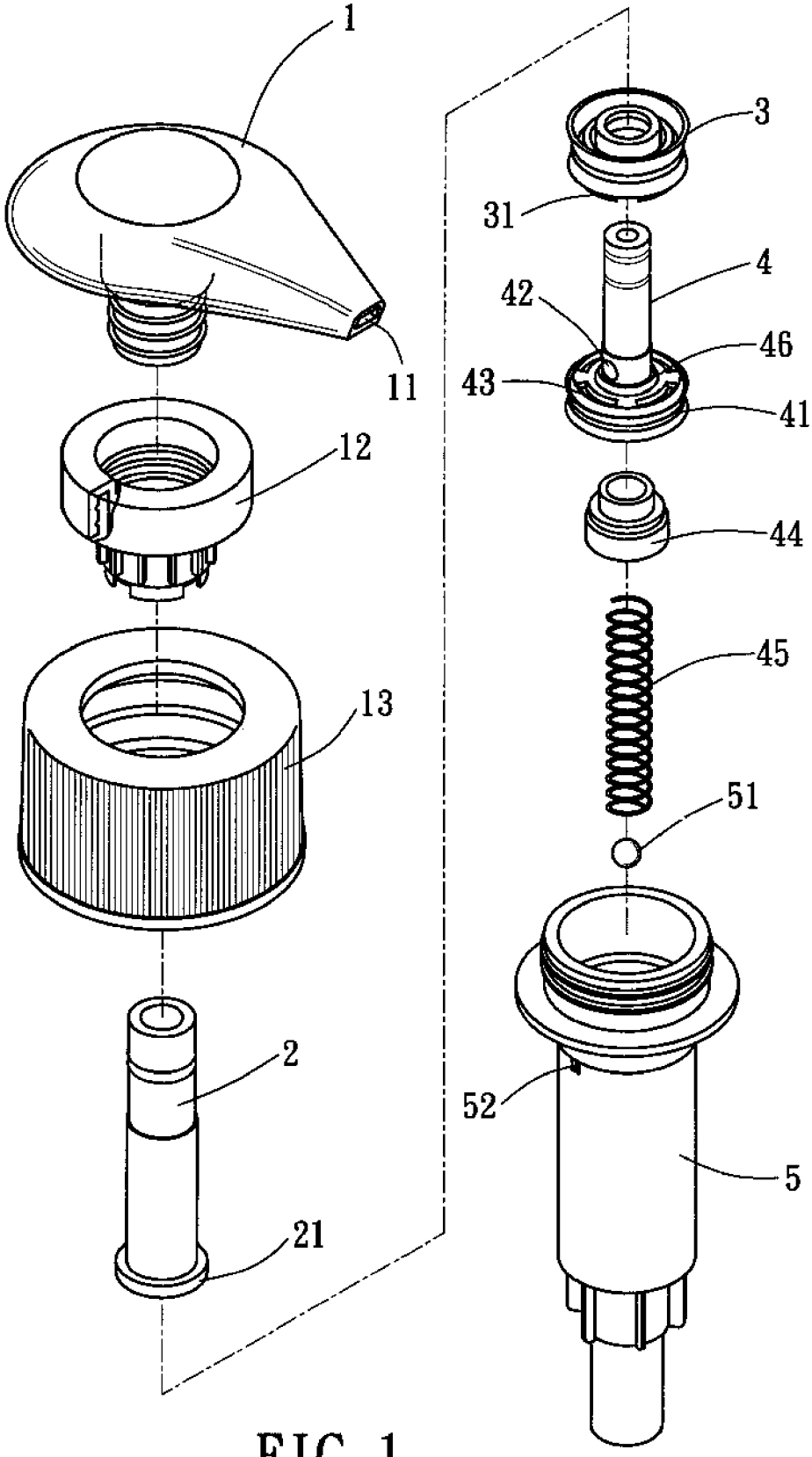
FIG. 1 is an exploded perspective view of the pump assembly with a pressable head of the present invention.
Figure 2:
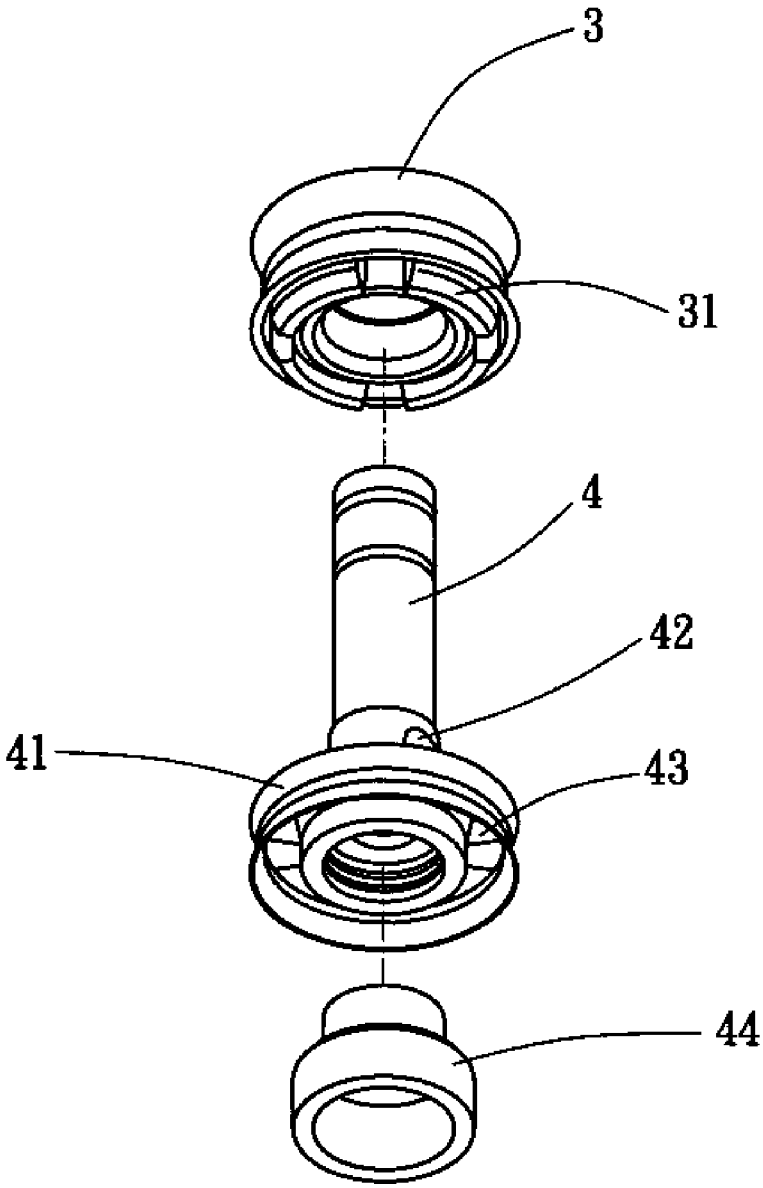
FIG. 2 is an exploded schematic view about the stop valve, inner tube and engaging unit of the present invention.
Figure 3:
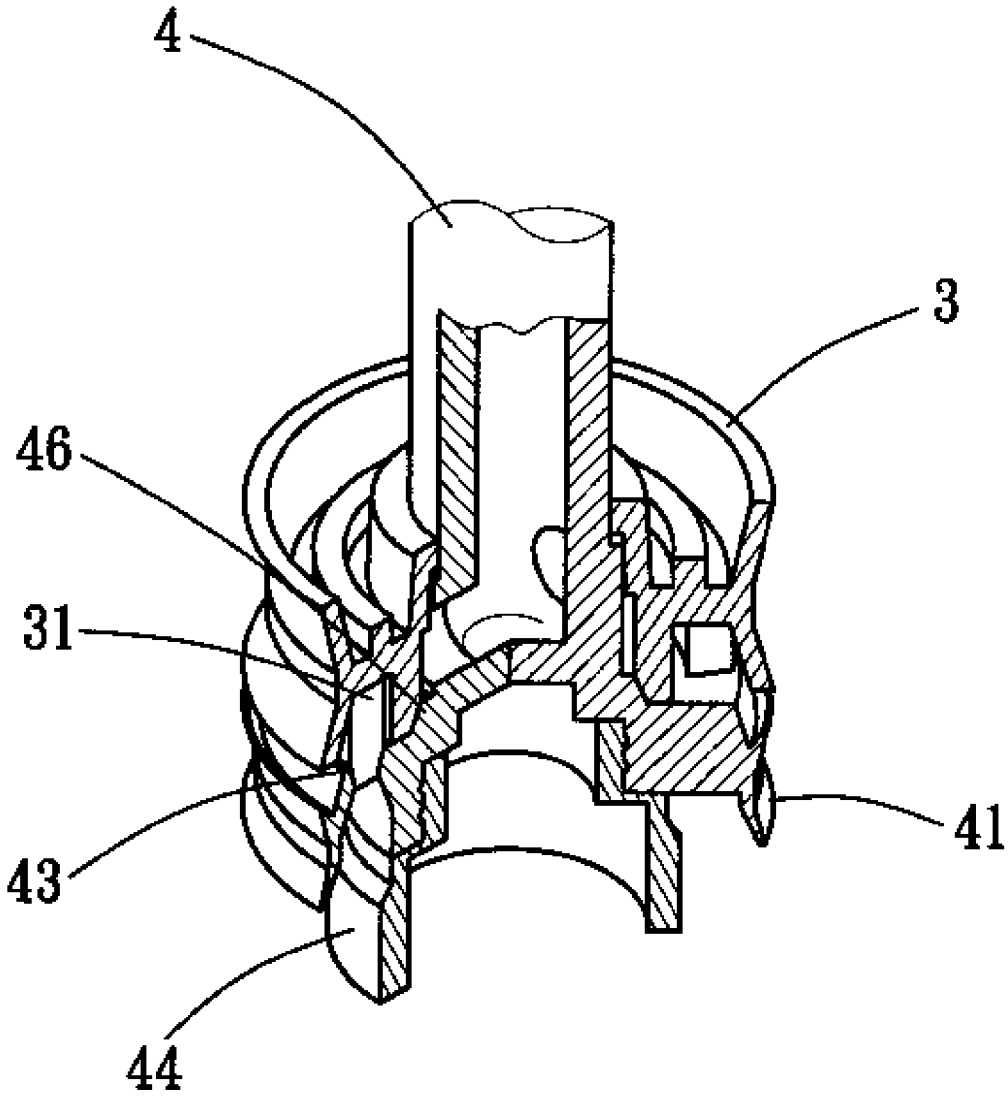
FIG. 3 is a schematic cross sectional view about the stop valve, inner tube and engaging unit of the present invention.
Figure 4:
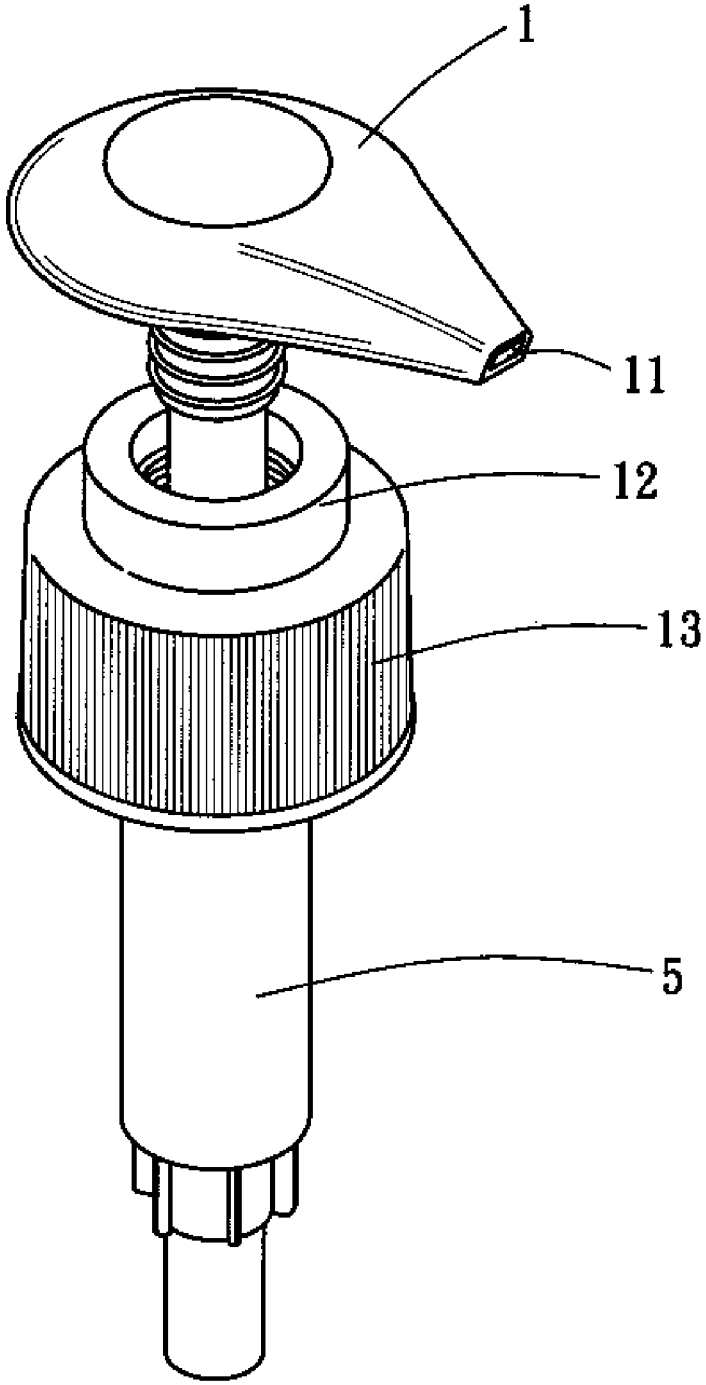
FIG. 4 shows an assembled view of the pump assembly with a pressable head of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the structure of the present invention is illustrated. The present invention includes a push tube 2, an inner tube 4, a stop valve 3, and an outer tube 5.

The push tube 2 is a tubular structure. A top of the push tube 2 passes through the outer tube 5 and a sealing unit 12 and is connected to a head 1. A lower end of the push tube 2 is installed with a shoulder 21. In assembly, the push tube 2 is communicated with the inner tube 4.

The inner tube 4 is a tubular structure. A bottom of the inner tube 4 has an annular plug 41 formed thereon. A connection of the inner tube 4 and the plug 41 has an inclined annular rib 46 disposed thereon. A guide hole 42 is defined in a lower end of the inner tube 4 near the annular plug 41. The guide hole 42 communicates with the inner tube 4. The annular plug 41 of the inner tube 4 has a plurality of via holes 43 defined therein. The via holes 43 have inclined inner walls. The stop valve 3 is disposed on a top of the inner tube 4. A lower end of the inner tube 4 is assembled with an engaging unit 44.

The stop valve 3 is a flat structure. An elastic structure is formed on a periphery of the stop valve 3. By the elastic deformation of the elastic structure, the stop valve 3 tightly adheres to an inner wall of the outer tube 5. A plurality of stoppers 31 protrude from a bottom of the stop valve 3. Each of the stoppers 31 has an inclined surface which corresponds to the inclined inner walls of the via holes 43. A bottom of the stop valve 3 is inclined with a slope corresponding to that of the annular rib 46 so that the stop valve 3 is tightly engaged with the annular plug 41.

The engaging unit 44 is engaged to a lower end of the inner tube 4. A bottom surface of the engaging unit 44 is concaved for receiving an elastic unit 45. The elastic unit 45 resists against a lower end of the outer tube 5.

The outer tube 5 is a tubular structure. An interior of the outer tube 5 is a stepped structure which has a greater diameter at an upper side and a smaller diameter at a lower side. A largest diameter of the interior of the outer tube 5 is greater than outer peripheries of the push tube 2 and the inner tube 4 such that the push tube 2 and the inner tube 4 are received in the outer tube. Two air holes 52 are defined in the outer tube 5 wherein the interior is at a largest diameter. A stop unit 53 for receiving a ball 51 is formed on the interior of a smallest diameter of the outer tube 5. The stop unit 53 provides a check function such that fluid flows unidirectionally.

The head 1 passes through the cover 13 and the sealing unit 12 to assemble with the push tube 2. The head 1 is assembled to a container 6 by using the cover 13. The head 1 has an outlet 11 which is communicated with the push tube 2. A top of the inner tube 4 passes through the stop valve 3 to be assembled to the push tube 2. A lower end of the inner tube 4 is connected to the engaging unit 44. The engaging unit 44 is assembled with the elastic unit 45. The elastic unit 45 is buckled to the inner wall of the outer tube 5. The stop unit 53 which is formed on the lower side of the interior of the outer tube 5 resists against the ball 51. The push tube 2, stop valve 3, inner tube 4 and engaging unit 44 are received in the outer tube 5.

Therefore, by pressing the head 1, the push tube 2 moves downwardly to drive the inner tube 4 to move downwardly. The shoulder 21 of the push tube 2 resists against the stop valve 3 so that the stop valve 3 is adhered to the outer tube 5 and to move downwardly. Thus, the elastic unit 45 is deformed by the pressure. The liquid in the inner tube 4 is compressed so that the liquid flows into the via holes 43 through the annular plug 41 and then flows out from the head 1. When the force applied to the head 1 disappears, the resilient force of the elastic unit 45 ejects the engaging unit 44 to drive the inner tube 4 to move upwardly. Therefore, the annular plug 41 moves upwardly to resist against the stop valve 3. Thus, the inclined inner walls of the via holes 43 of the annular plug 41 are corresponding to the inclined surfaces of the stoppers 31 of the stop valve 3. The via holes 43 are tightly engaged with the stoppers 31. Thereby, an isolation layer 7 is formed between the annular plug 41 and the stop valve 3 so as to retain the tight sealing effect between the inner tube 4 and the outer tube 5 even when the plug 41 or the stop valve 3 is not tightly sealed with the outer tube 5. By the isolation layer 7, the inner tube 4 and the outer tube 5 are retained in a tight seal state. No liquid drains out.

Figure 5:
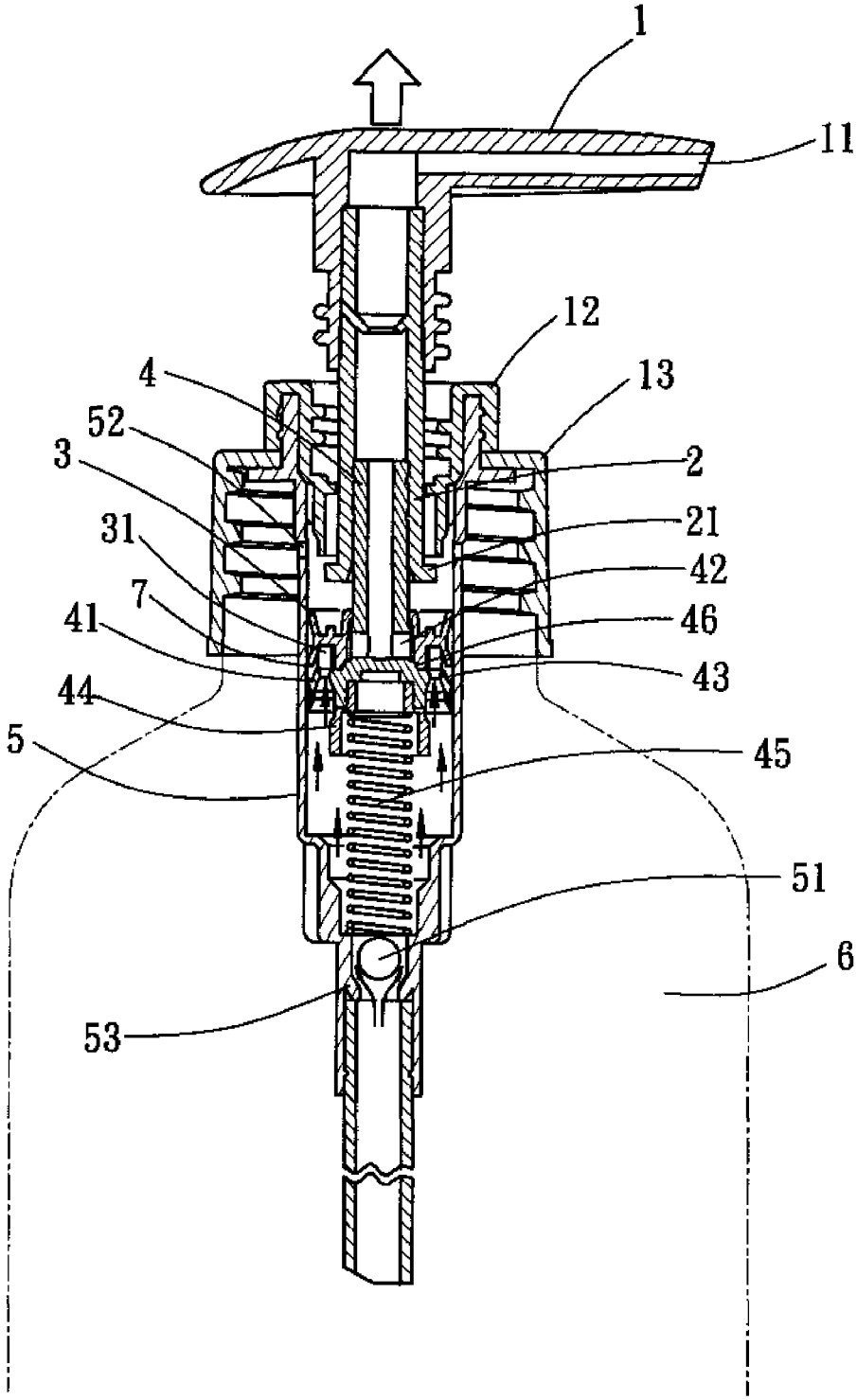
FIG. 5 is a schematic cross sectional view showing the suction operation of the present invention.
Figure 6:
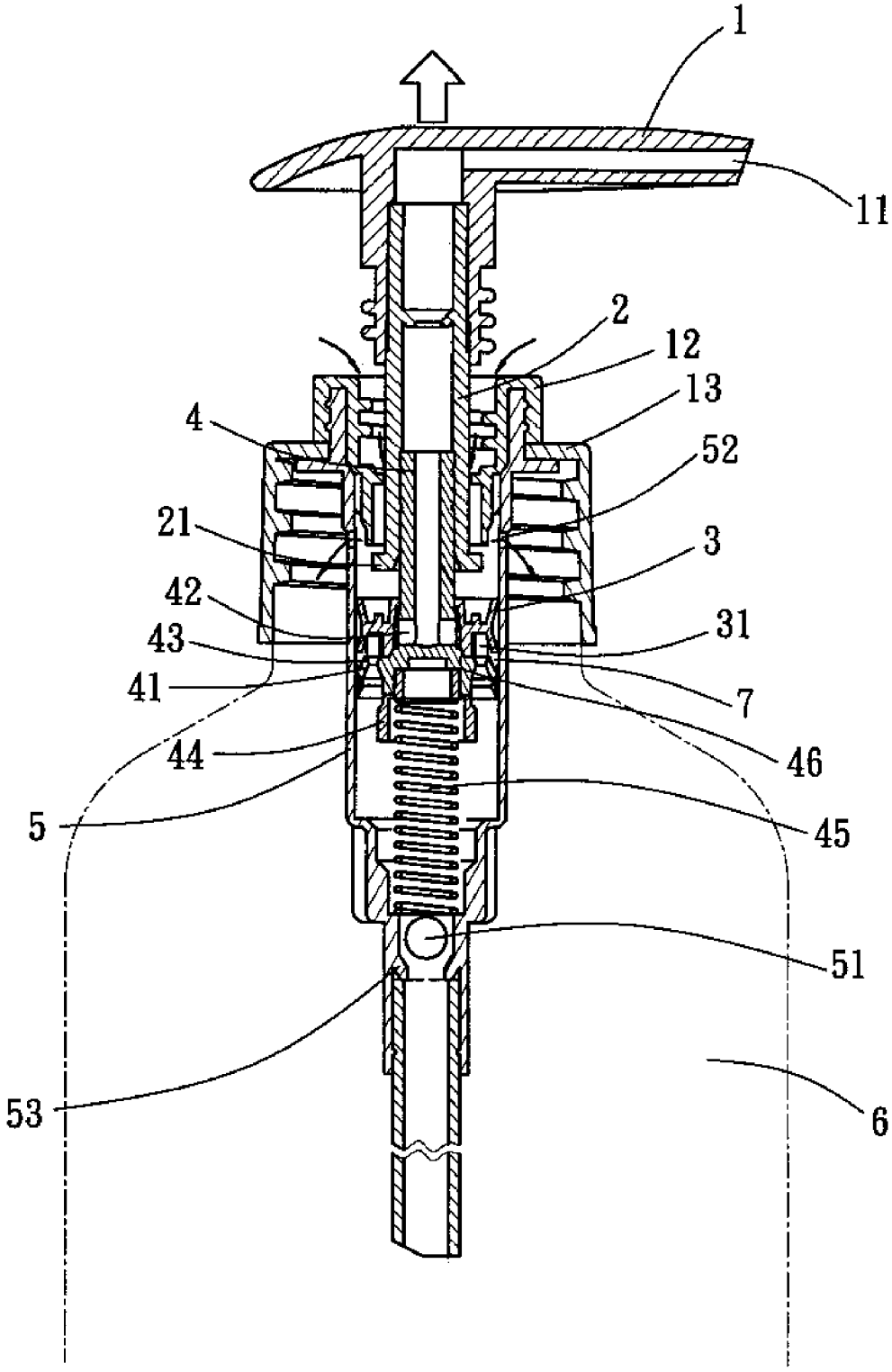
FIG. 6 is a schematic cross sectional view showing the air suction operation according to the present invention.
Figure 7:
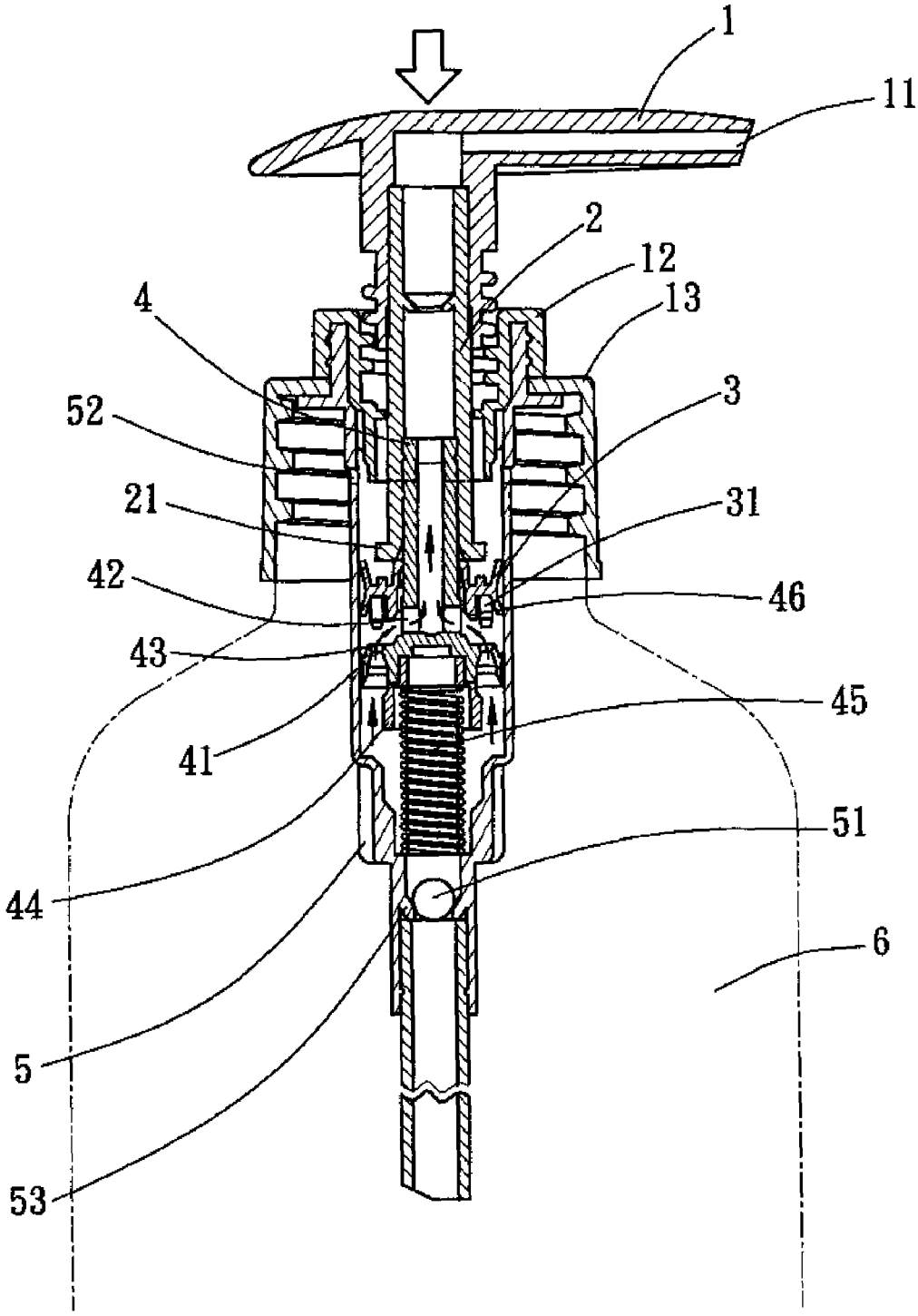
FIG. 7 is a schematic cross sectional view showing the extrusion operation of the present invention.

Referring to FIGS. 5 to 7, the operation of the present invention is presented. With reference to FIG. 5, the user releases the head 1 after pressing, the elastic unit 45 pushes the engaging unit 44, inner tube 4 and the annular plug 41 to move upwards. Then, since a receiving space between the annular plug 41 and the outer tube 5 expands, the reduction of the pressure generates an upward absorption force, driving the ball 51 to move upwardly and the liquid in the container 6 is sucked. An interior space of the container 6 is expanded to reduce the pressure. Then air is absorbed by the two air holes 52 defined in the outer tube 5 so as to compensate the interior space reducted. Thereby the intake operation is complete.

When the user presses the head 1, as shown in FIG. 7, the head 1 extrudes the push tube 2 to move axially downward. The push tube 2 interacts with the inner tube 4 and the annular plug 41 so that the inner tube 4 and the annular plug 41 move downwards. Then the shoulder 21 resists against the stop valve 3 to refrain the stop valve 3 from moving downward. A step difference between the stop valve 3 and the inner tube 4 unseals the guide hole 42 which communicates with the inner tube 4. The annular plug 41 compresses the liquid between the annular plug 41 and the inner tube 4, such that the liquid pushes the ball 51 to seal the bottom of the outer tube 5, therefore the liquid sequentially flows from the via holes 43 to the guide hole 42, the inner tube 4, and the push tube 2. Thus completes the intake of liquid.

When the space between the plug 41 and the stop valve 3 is filled with the intake liquid, as the user releases the head 1, the elastic unit 45 returns to a position illustrated in FIG. 5. The inclined inner walls of the via holes 43 of the annular plug 41 are corresponding to that of the stoppers 31 of the stop valve 3, the via holes 43 are tightly engaged to the stoppers 31. Furthermore, by the annular ribs 46 corresponding to the bottom of the stop valve 3, when the annular plug 41 pushes upwards, the annular plug 41 engages with the stop valve 3. Therefore, the guide hole 42 is sealed by the stop valve 3, and the isolation layer 7 is formed between the annular plug 41 and the stop valve 3. The present invention is mainly used on bath cleaning liquid, especially emulsion or glue. Thus, the isolation layer 7 provides sufficient sealing effect between the annular plug 41 and the stop valve 3. The isolation layer 7 fills the cracks between the annular plug 41 and the stop valve 3.

Figure 8:
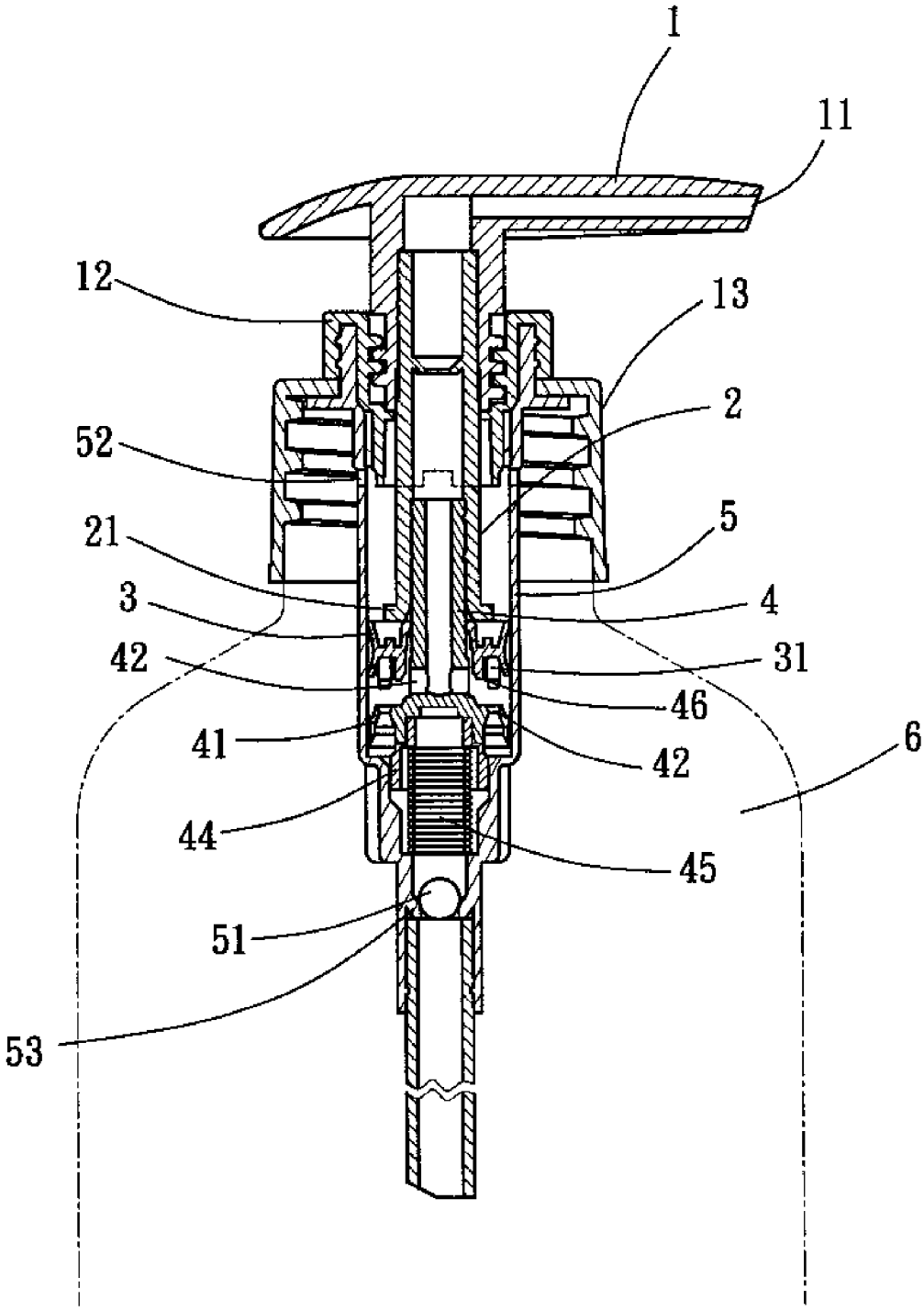
FIG. 8 is a schematic cross sectional view includes an initial state of the present invention.
Figure 9:
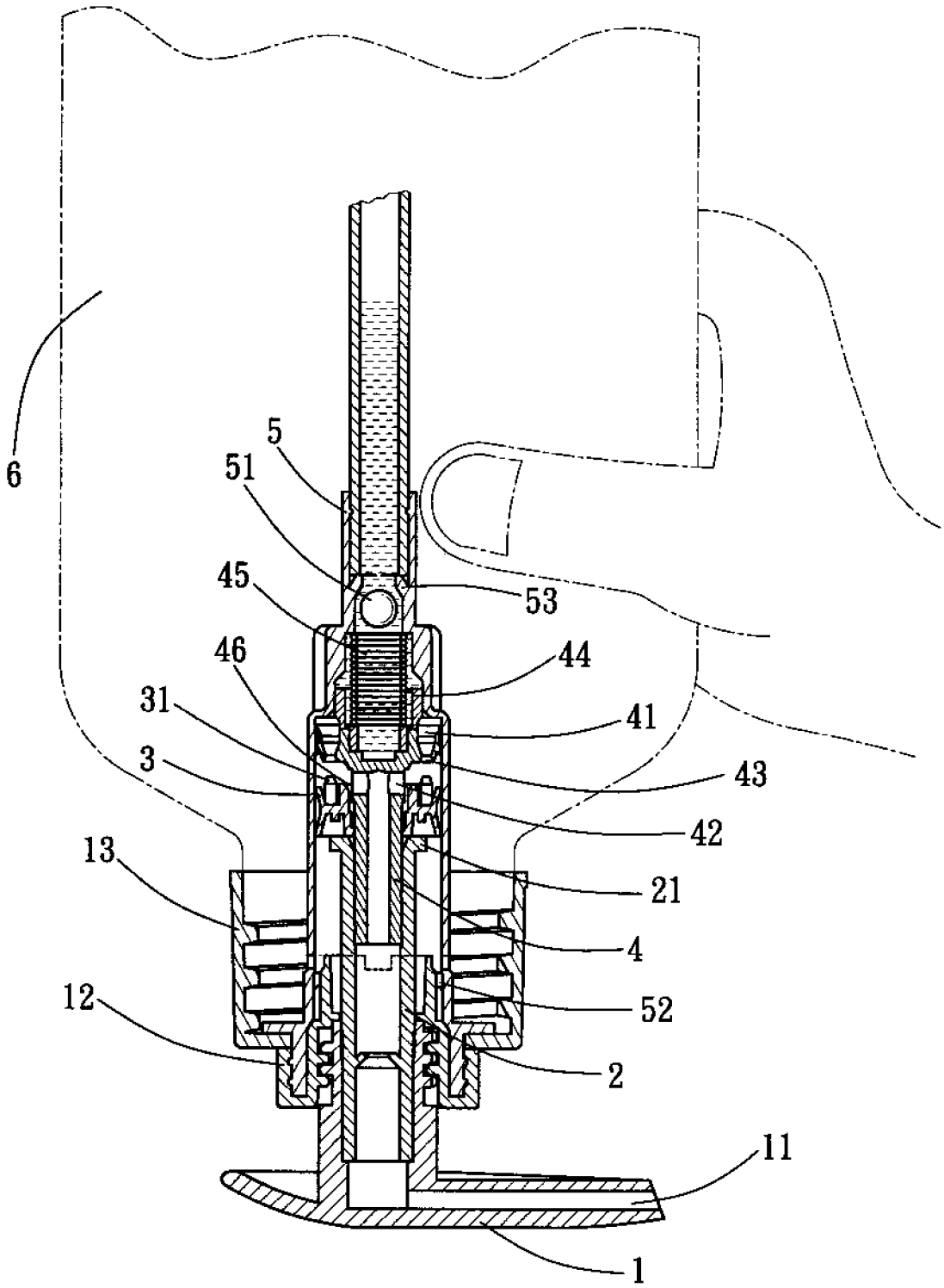
FIG. 9 is a schematic cross sectional view of FIG. 8.

Referring to FIGS. 8 to 11, in FIG. 8, initially, the head 1 is locked to the sealing unit 12. Then the annular plug 41 is pressed by the head 1 to push the inner tube 4 and the engaging unit 44 such that the elastic unit 45 is pressed by the engaging unit 44. The engaging unit 44 resists against the inner wall of the outer tube 5. Referring to FIG. 9, when the container 6 is positioned reversely, the ball is not resisted against the stop unit 53 due to gravitational force. The liquid flows from the bottom of the container 6. Since the engaging unit 44 is tightly engaged with the inner tube 4, the liquid does not flow to the guide hole 42. Thus, no liquid drains out from the container 6.

Figure 10:
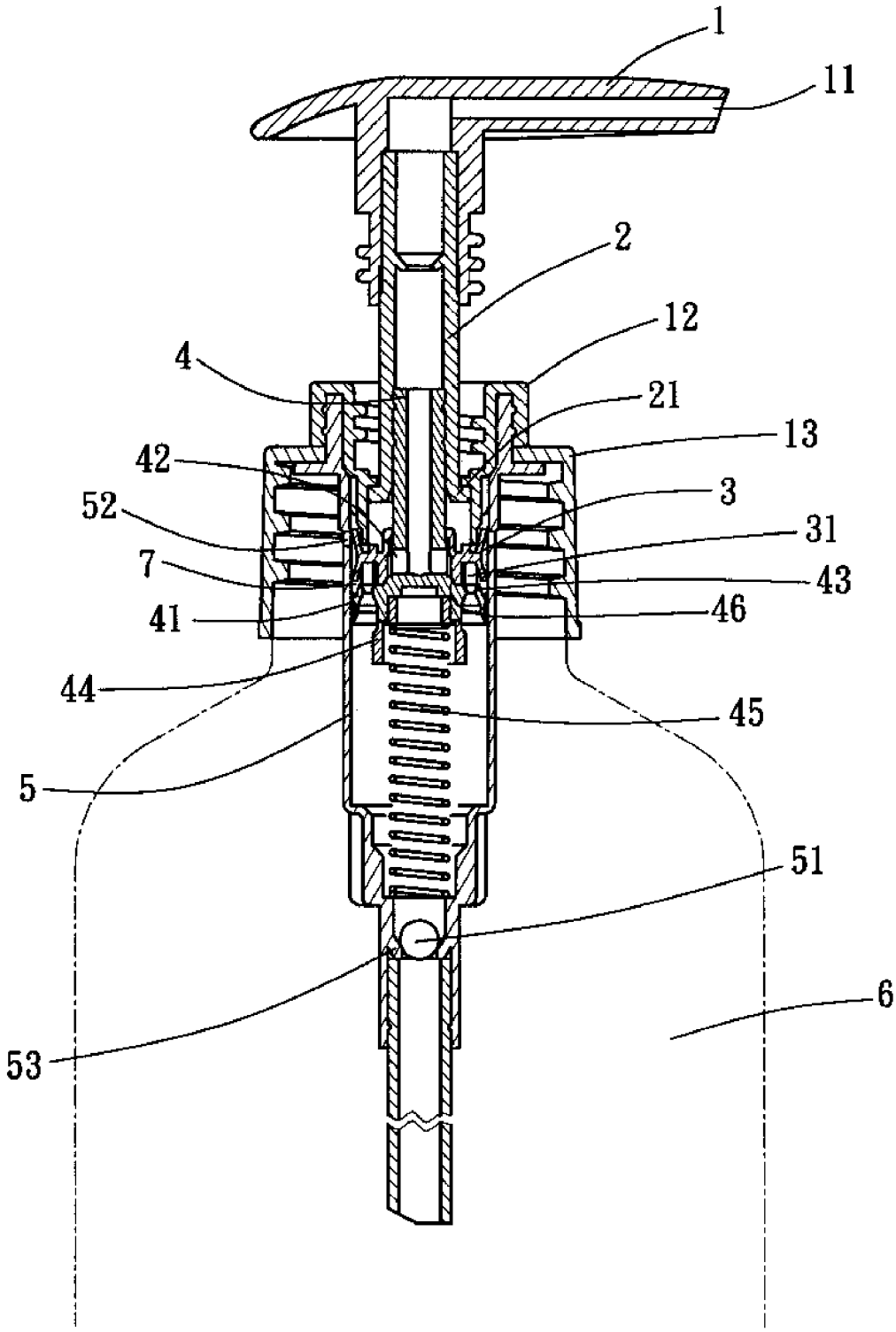
FIG. 10 is a schematic cross sectional view showing that the present invention is used.
Figure 11:
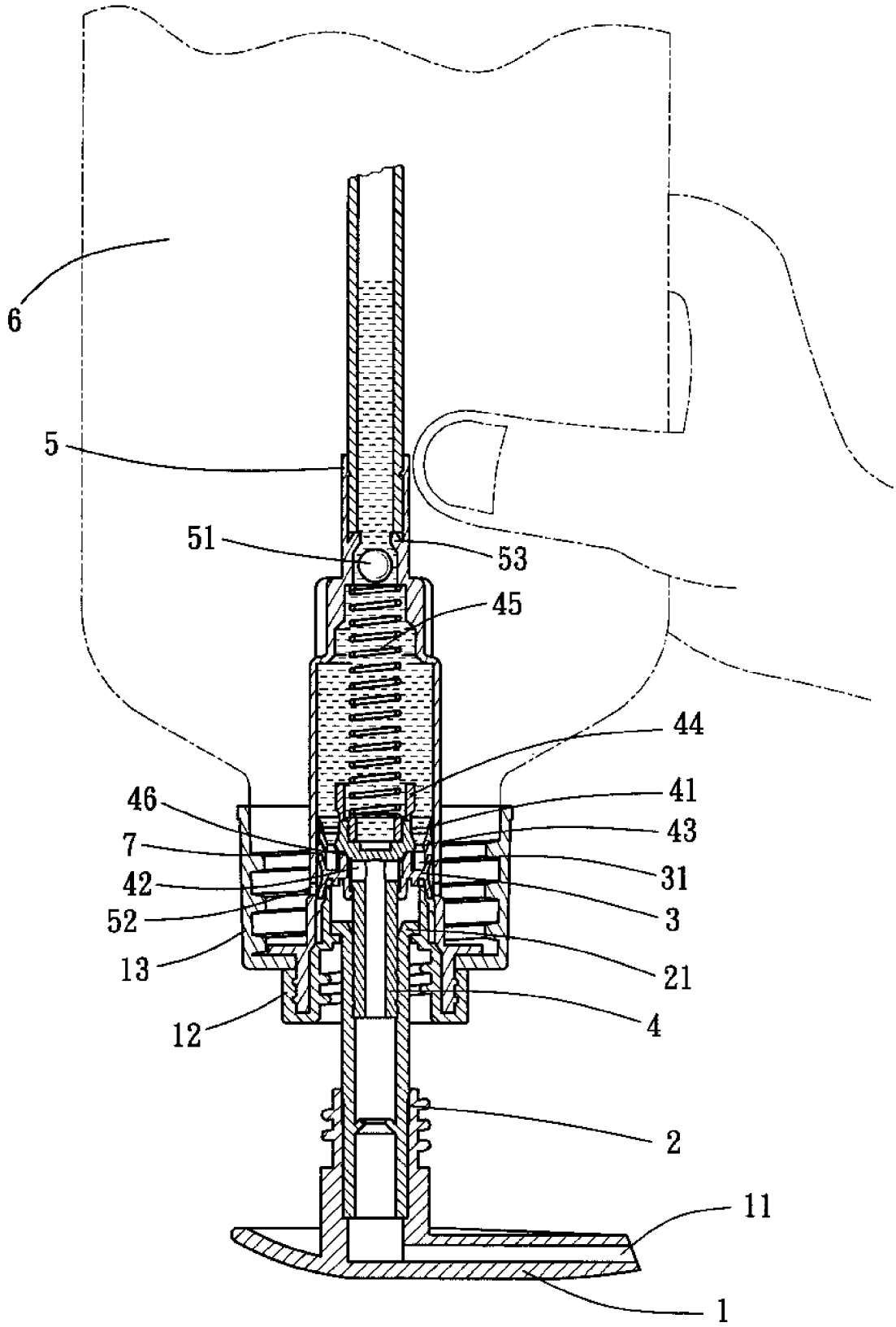
FIG. 11 is a schematic cross sectional view showing a reverse state of FIG. 10.

Referring to FIG. 10, when the head 1 is opened for the first time the elastic structure formed on the periphery of the stop valve 3 tightly engages with the inner wall of the outer tube 5. When the user presses the head 1 several times, the elastic unit 45 returns elastically to push the engaging unit 44 so as to drive the annular plug 41 and the inner tube 4 to move upwardly. The annular plug 41 sucks the liquid from the container 6 to the outer tube 5. The via holes 43 of the inner tube 4 are engaged to the stoppers 31 of the stop valve 3, and the guide hole 42 of the inner tube 4 is sealed by the stop valve 3. Each time the head 1 is pressed, the isolation layer 7 is structurally enhanced so as to continuously retain a very good sealing effect. When the container is reversely positioned, as illustrated in FIG. 11, the ball 51 is not resisted against the stop unit 53 due to gravitational force. As liquid flows from the bottom of the container 6, the isolation layer 7 which is formed between the stop valve 3 and the plug 41 refrains the liquid from flowing out.

Figure 12:
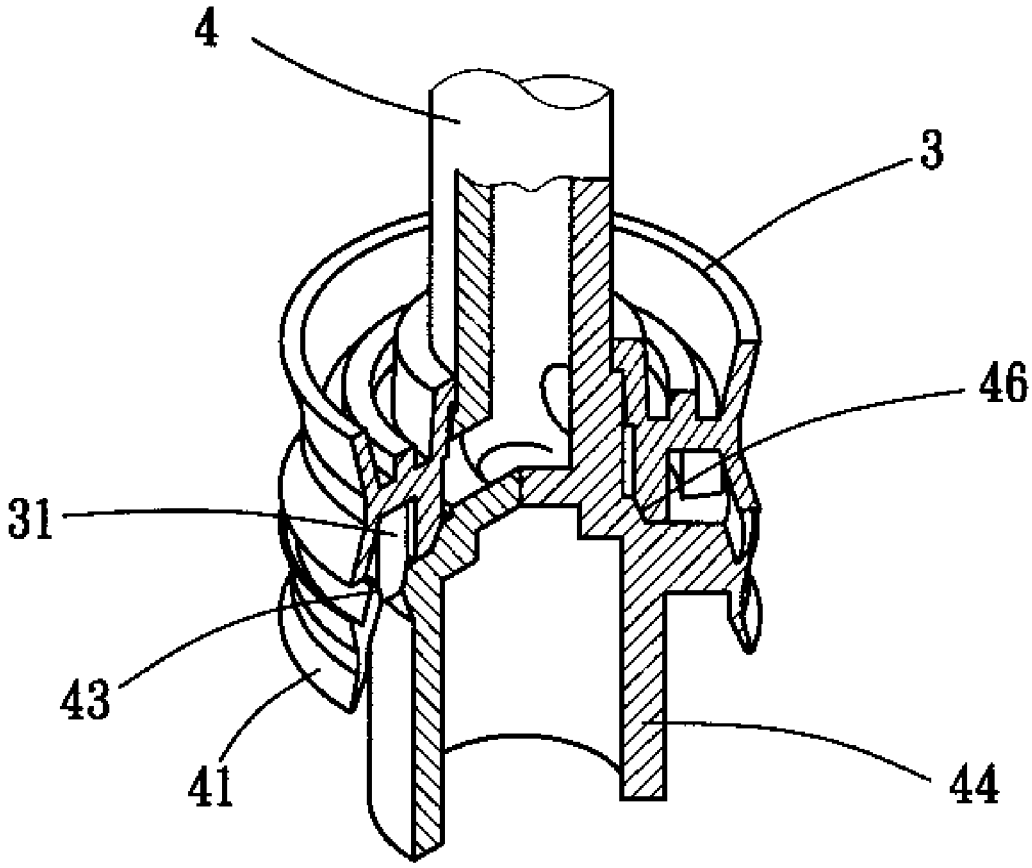
FIG. 12 is an assembled view about the second embodiment of the present invention.
Figure 13:
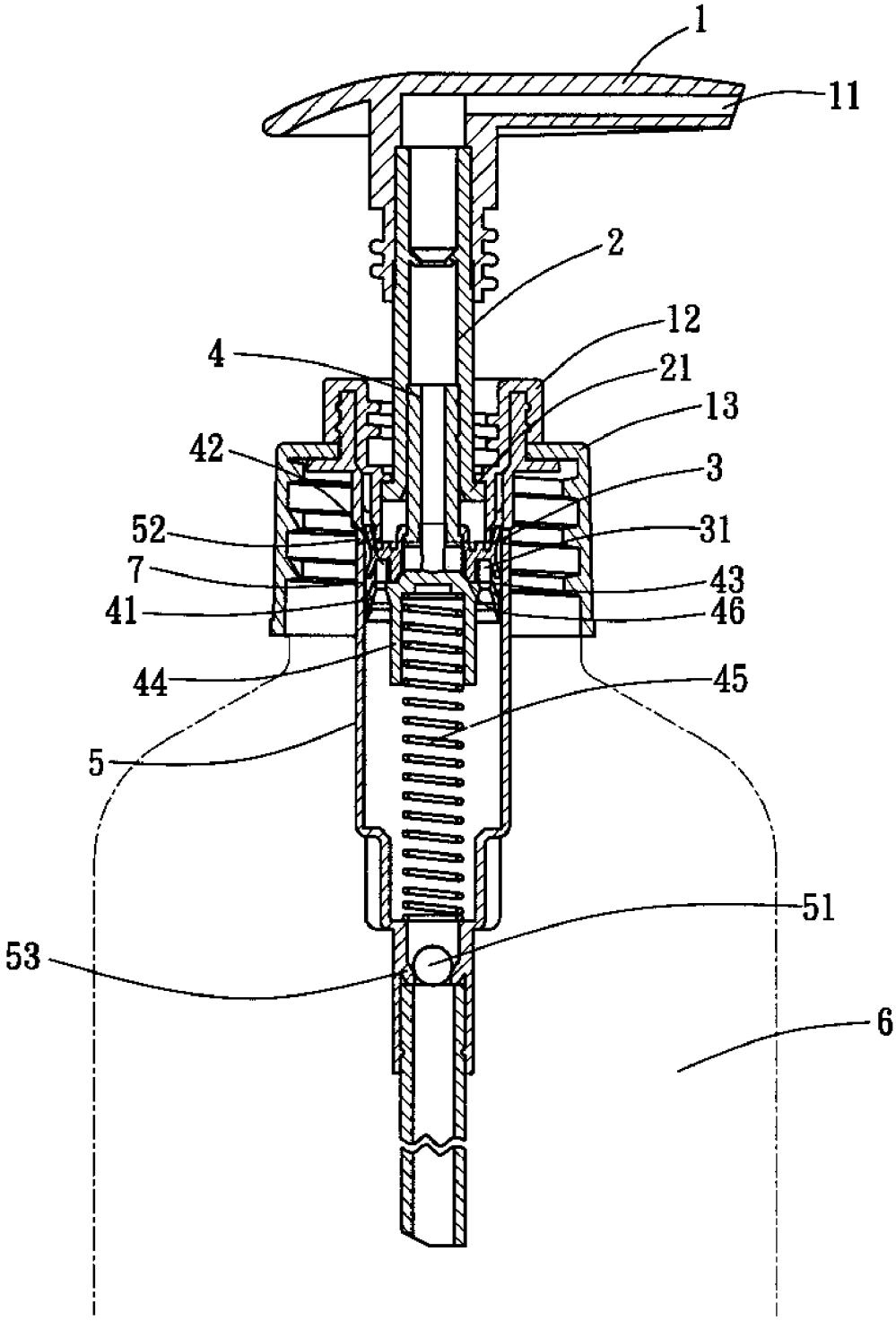
FIG. 13 is a cross section view showing the application of the second embodiment of the present invention.

Referring to FIGS. 12 and 13, the second embodiment of the present invention is illustrated. In this embodiment, the engaging unit 44 is integrally formed with the annular plug 41 of the inner tube 4. An inner diameter of the engaging unit 44 is greater than the engaging unit 44 in the first embodiment so as to be used with an elastic unit 45 with a greater diameter. Thus, the elastic unit 45 is justly installed in the engaging unit 44 to have the same effect. When the receiving space of the outer tube 5 is too small, while a great elastic unit 45 is necessary, if the elastic unit 45 is installed in the annular plug 41, it will induce that the space needed is too large. Thus a thickness of the wall and a structural strength of the annular plug 41 are insufficient. Thus the engaging unit 44 of the first embodiment with a greater inner diameter is installed in the annular plug 41 so as to retain an elasticity of the elastic unit 45. The elastic unit 45 will not shift.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A pump assembly with a pressable head, comprising a push tube, an inner tube, a stop valve, and an outer tube;

the push tube being a tubular structure; a top of the push tube passing through the outer tube; the push tube communicated with the inner tube;

the inner tube being a tubular structure; a bottom of the inner tube having an annular plug formed thereon; the annular plug having a plurality of via holes defined therein, the via holes having inclined inner walls; the stop valve disposed on a top of the inner tube;

the stop valve being a flat structure; an elastic structure formed on a periphery of the stop valve; by elastic deformation of the elastic structure, the stop valve tightly adhered to an inner wall of the outer tube; a plurality of stoppers protruded from a bottom of the stop valve and corresponding to the via holes; and the outer tube being a tubular structure; an interior of the outer tube being a stepped structure having a greater diameter at an upper side and a smaller diameter at a lower side; a largest diameter of the interior of the outer tube being greater than outer peripheries of the push tube and the inner tube so that the push tube and inner tube are received in the outer tube.

2. The pump assembly with a pressable head as claimed in claim 1, wherein a lower end of the inner tube is assembled with an engaging unit for installing with an elastic unit.

3. The pump assembly with a pressable head as claimed in claim 2, wherein the elastic unit is a spring.

4. The pump assembly with a pressable head as claimed in claim 1, wherein a connection of the inner tube and the plug has an inclined annular rib.

5. The pump assembly with a pressable head as claimed in claim 1, wherein each stopper having an inclined surface corresponding to the inclined inner walls of the via holes.

6. The pump assembly with a pressable head as claimed in claim 1, wherein the outer tube is formed with at least one air hole.

7. The pump assembly with a pressable head as claimed in claim 1, wherein an interior of the outer tube has a stop unit formed thereon for receiving a ball which provides a check function so that fluid flows unidirectionally.

8. The pump assembly with a pressable head as claimed in claim 1, wherein a guide hole is defined in a lower end of the inner tube, the guide hole communicated with the inner tube.

9. The pump assembly with a pressable head as claimed in claim 1, wherein a lower end of the push tube is installed with a shoulder.

10. The pump assembly with a pressable head as claimed in claim 1, wherein an engaging unit is engaged to a lower end of the inner tube.

11. The pump assembly with a pressable head as claimed in claim 1, wherein a bottom surface of the engaging unit is concaved for assembling with the elastic unit; the elastic unit resisted against a lower end of the outer tube.

12. The pump assembly with a pressable head as claimed in claim 1, wherein a bottom of the stop valve is inclined with a slope corresponding to that of the annular rib so that the stop valve is tightly engaged with the plug.

* * * * *